United States Patent [19]

Carbonneau et al.

[11] Patent Number: 4,665,795

[45] Date of Patent: May 19, 1987

[54] GUN MUZZLE REFERENCE SYSTEM

[75] Inventors: Raymond Carbonneau, Cap-Rouge; Jacques Dubois, Neufchatel, both of Canada

[73] Assignee: Her Majesty the Queen in right of Canada, Canada

[21] Appl. No.: 563,172

[22] Filed: Dec. 19, 1983

[30] Foreign Application Priority Data

Apr. 29, 1983 [CA] Canada ..... 427089

[51] Int. Cl.[4] ..... F41G 3/08

[52] U.S. Cl. ..... 89/41.03; 89/41.06; 356/152

[58] Field of Search ..... 89/14.05, 41.03, 41.06; 356/152

[56] References Cited

U.S. PATENT DOCUMENTS

| | | | |
|---|---|---|---|
| 3,684,383 | 8/1972 | Johansson | 89/14.05 |
| 3,989,384 | 11/1976 | Friedman | 89/41.06 |
| 4,020,739 | 5/1977 | Piotrowski | 89/41.06 |
| 4,142,799 | 3/1979 | Barton | 89/41.03 |
| 4,383,474 | 5/1983 | Paurus et al. | 89/41.03 |

FOREIGN PATENT DOCUMENTS

| | | | |
|---|---|---|---|
| 2909629 | 9/1980 | Fed. Rep. of Germany | 89/41.03 |

*Primary Examiner*—Deborah L. Kyle
*Assistant Examiner*—Ted L. Parr
*Attorney, Agent, or Firm*—Stevens, Davis, Miller & Mosher

[57] ABSTRACT

A muzzle reference system is provided for correcting errors in aiming signals produced by a fire-control system of an artillery gun having a gun muzzle pivotable about a first axis and movable about a second axis extending perpendicularly of the first axis. A laser beam transmitting unit adapted to be mounted on the gun for movement with the barrel about the second axis, directs a laser beam along an optical axis in response to an activating signal. A reflection unit, adapted to be mounted at the distal end of the barrel, reflects a laser beam received from the transmitting unit along the optical axis substantially along a reference optical axis at a predetermined angular position of the barrel about the first axis. A laser beam receiving unit, adapted to be mounted on the gun, receives a laser beam reflected substantially along the reference optical axis and produces signals representative of the deviation of the reflected beam from the perdetermined optical axis. A processing unit connected to the receiving unit and adapted to be connected to the fire-control system converts the deviation representative signals to aiming correction signals and adds the latter to the aiming signals. Monitoring means monitors the position of the barrel about the first axis and applies the activating signal to the transmitting unit when the barrel is at its predetermined position.

24 Claims, 12 Drawing Figures

GUN MUZZLE REFERENCE SYSTEM

This invention relates to an artillery muzzle reference system.

BACKGROUND OF THE INVENTION

As is well known, the barrel of an artillery gun, such as a tank and the like, must be angularly displaced from the gunner's line of sight by an appropriate angle in order that the projectile strike the target at which the muzzle was aimed. The angle is a function of a number of factors including the distance to and motion of the target, the ejection speed of the projectile, cross winds and others. The vertical component of the angle is known as the "superelevation angle" while the horizontal component is known as the "lead angle".

Modern fire-control systems utilize a computer to calculate the superelevation angle and the lead angle on the basis of signals provided by a number of sensors and then automatically align a gunner's sight with respect to the axis of the gun barrel. Notwithstanding the sophistication of fire-control systems, the accuracy of the gun is reduced because of various and unavoidable errors which result from gun droop and thermal distortion of the gun barrel and other components. Systems which detect, measure and compensate for these errors are known generally as "muzzle reference systems".

One known muzzle reference system provides a diffuse light source mounted on the turret roof of a tank, a mirror mounted at the muzzle end of the barrel, a deflection prism and focusing lens arrangement incorporated in the gunner's sight and a reference circle superimposed on the reticle pattern of the gunner's sight lens. To compensate for error, the gunner sets the gun barrel to a predetermined position or angle and activates the light source. The mirror reflects a portion of the light beam generated by the light source through the prism and lens arranged on the gunner's lens. The magnitude and direction of the displacement of the beam with respect to the reference circle on the gunner's lens is a measure of the error. The gunner manually adjusts bore citing knobs to move the beam into the reference circle. While this system is adequate for some tank configurations, it requires a line of sight between both the light source and the mirror and the mirror and the gunner's lens—an option which is not available on all tank configurations. In addition, the diffuse light source may reveal the location of the tank during night use. A significant drawback of this system is that the error compensation process is time consuming because the barrel must be stationary during calibration and adjustments must be effected manually.

A modification of the above described prior art system involves replacing the light source and mirror with a collimator positioned at the end of the muzzle and aimed at the deflection prism in a reference position of the barrel. The operation of this system is essentially the same as the parent system and, accordingly, the modified system suffers substantially the same disadvantages. In addition, however, the collimator is a complex and fragile device which requires sophisticated mechanical design to withstand the high acceleration generated by a gun blast.

Another muzzle reference system provides a laser source mounted on the tank, a diverging lens mounted along the optical axis of the beam produced by the laser source, a beam splitter positioned along the optical axis, a retroreflector mounted at the end of the gun muzzle and an optical detector positioned adjacent the beam splitter. The diverging lens diverges the laser beam over an area at the gun muzzle compatible with expected errors. To compensate for error, the gunner sets the barrel at a predetermined position and activates the light source. The retroreflector reflects a portion of the incident beam back towards the beam splitter which, in turn, reflects the beam onto the detector. The detector produces an electrical output signal representative of the displacement of the gun muzzle from the reference position. A deformation equation must be used to transform the positional error to an angular error. This system is considered superior to the aforementioned systems in that it does not include large optical components on the muzzle, does not require a line of sight from the gunner's sight to the muzzle and the mode of operation is susceptible to a fully automatic configuration. However, the technique is severely handicapped by the requirement of complex equations which link the desired angular error to the measured positional error and which must include compensation for sun heating with and without cooling and so forth.

A still further system which may fall within this general category has been specifically developed for measuring gun droop and thus is not a complete muzzle reference system. In general, this arrangement provides a laser transmitter mounted on the turret, a mirror mounted at the muzzle end of the gun barrel and a receiver having a position sensing device also mounted on the turret. The transmitter directs a beam at the mirror which, at a predetermined position of the muzzle, reflects the beam towards an aperture in the receiver in which the position sensing detector is disposed. The receiver is of the form of a camera which focuses the beam onto the position sensing detector in the focal plane of the camera lens. As the gun muzzle bends,the angular motion of the beam causes the focused light on the detector to translate linearly. This system is superior to the aforementioned systems because it measures required angular displacement of the muzzle as opposed to positional displacement. However, this system provides only muzzle-to-mirror compensation and additional means are required to provide the mirror-to-line of sight error compensation necessary for a complete muzzle reference system.

SUMMARY OF THE INVENTION

The present invention seeks to provide a muzzle reference system which quickly and automatically provides superelevation and lead angle correction signals for addition to the superelevation and lead angle signals generated by the fire-control system computer of artillery equipment.

In accordance with the present invention, there is provided a muzzle reference system for correcting errors in aiming signals produced by a fire-control system of an artillery gun having a gun barrel pivotable about a first axis and movable about a second axis extending perpendicularly of the first axis. The muzzle reference system is comprised of laser beam transmitting means adapted to be mounted on the gun for movement with the barrel about the second axis and directing a laser beam along an optical axis in response to an activating signal; means adapted to be mounted at the muzzle end of the barrel for reflecting a laser beam received from the transmitting means along the optical axis substantially along a reference optical axis at a predetermined angular position of the barrel about the first axis; laser beam receiving means adapted to be mounted on the gun for receiving a laser beam reflected substantially along the reference optical axis and producing signals representative of the deviation of the reflected beam from the predetermined optical axis; means connected to the receiving means and adapted to be connected to the fire-control system for converting the deviation representative signals to aiming correction signals and for adding the latter to the aiming signals; and means for monitoring the position of the barrel about the first axis and applying the activating signal to the transmitting means when the barrel is at its predetermined position.

BRIEF DESCRIPTION OF THE DRAWINGS

These and other features of the invention will become more apparent from the following description in which reference is made to the appended drawings, wherein.

DESCRIPTION OF A PREFERRED EMBODIMENT

Figure 1:
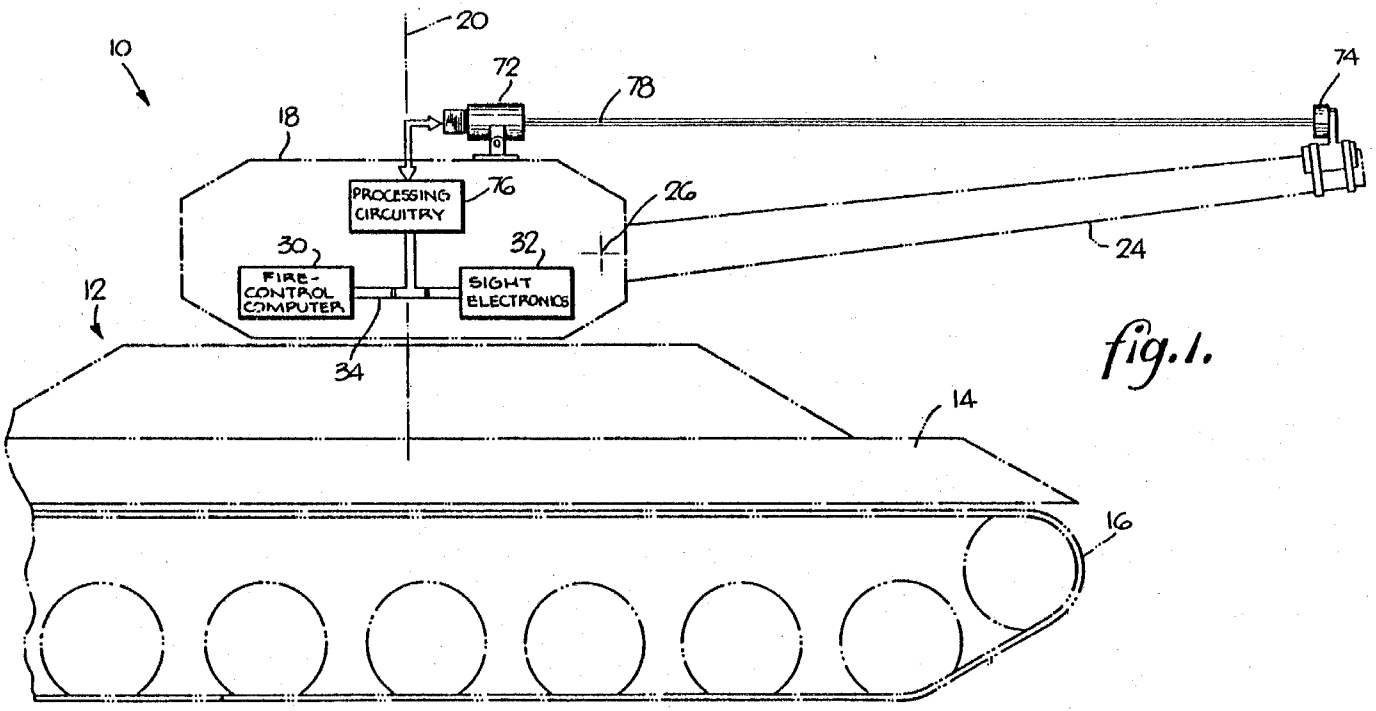
FIG. 1 is a diagrammatic side elevational view of an artillery tank illustrating the basic components of the muzzle reference system of the present invention.

FIG. 1 diagrammatically illustrates a tank 10 having a support structure 12 including a base 14, mounted on endless tracks 16, and a turret 18 mounted on base 14 for pivotal movement about a vertical axis 20. A gun barrel 24 is mounted on the turret for movement about a horizontal axis 26. The tank 10 further includes a conventional fire-control system computer 30 which is programmed to compute the superelevation angle and the lead angle on the basis of the signals provided by a number of sensors (not shown). The computer produces electrical analog signals representative of the appropriate superelevation and lead angles and feeds them to a gunner's sight electronics circuit 32 via cable 34. Circuit 32 applies appropriate signals to electro-mechanical components (not shown) which slave the gunner's sight to the movement of the gun. The tank also includes a gun angle resolver 48 which produces electrical signals representative of the vertical angular position of barrel 24.

Figure 2:
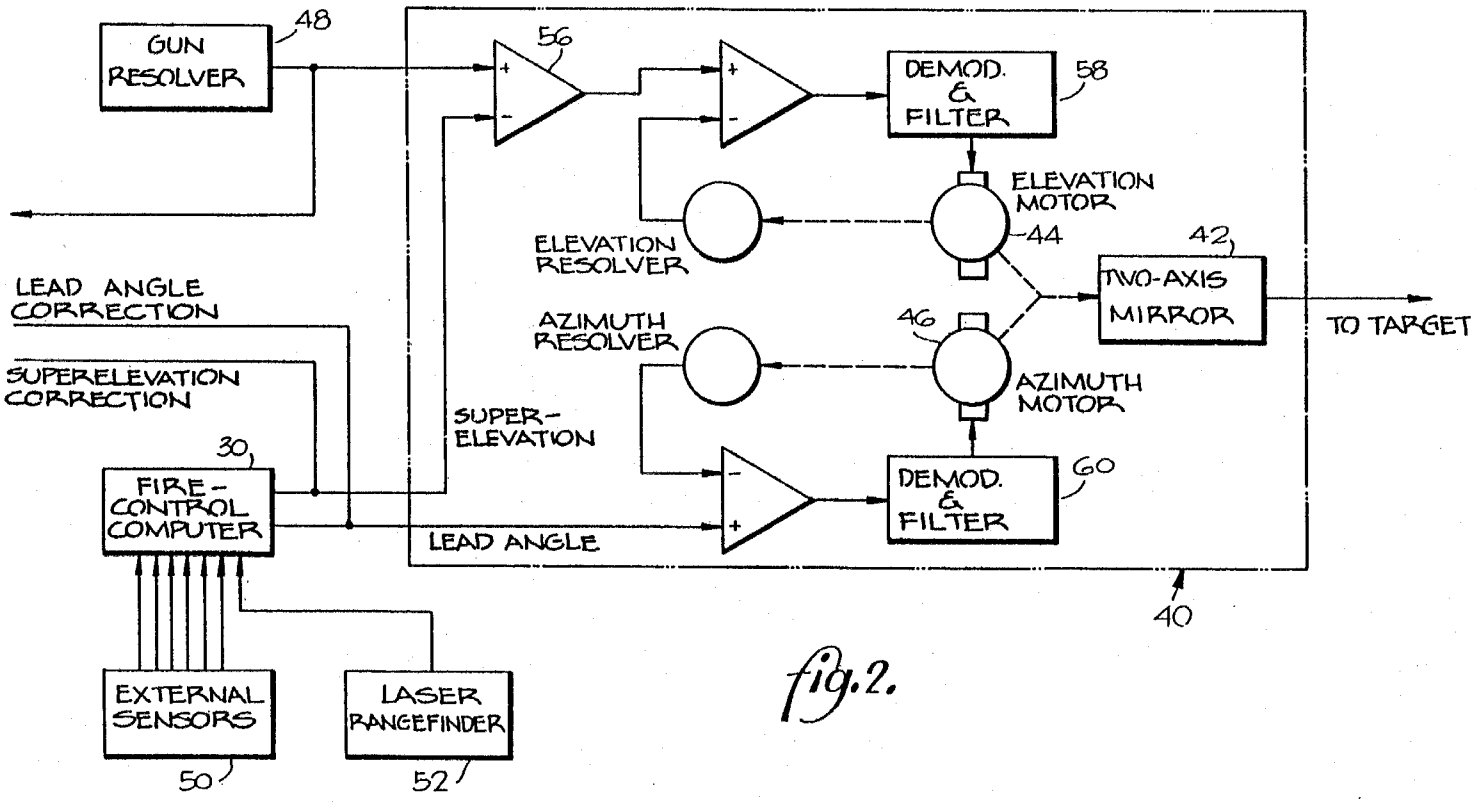
FIG. 2 is block diagram illustrating a typical fire-control system and a typical sighting system of a tank.

FIG. 2 illustrates the basic components of a typical integrated fire-control system. A gunner's sighting system 40 has a sighting telescope (not shown), the field of view of which is adjusted by means a two-axis mirror 42 controlled by elevation and azimuth DC torque motors 44 and 46. Gun angle resolver 48 produces an analog signal representative of the vertical angle of the barrel while, as previously mentioned and well known, the fire-control computer produces electrical analog signals, at a frequency of 500 Hz, representative of the desired superelevation and lead angles as a function of signals provided by external sensors 50 and a laser rangefinder 52. The superelevation and gun elevation signals are added together in adder 56 and the sum is fed to motor 44 via a synchronous demodulator and filter circuit 58 which converts the 500 Hz signal to DC. Similarly, the 500 Hz lead angle signal output by computer 30 is fed to motor 46 via synchronous demodulator and filter circuit 60.

The present invention provides an apparatus which detects elevational and azimuthal errors, produces superelevation and lead angle correction signals and adds them to the superelevation and lead angle signals, respectively, produced by computer 30.

Figure 3:
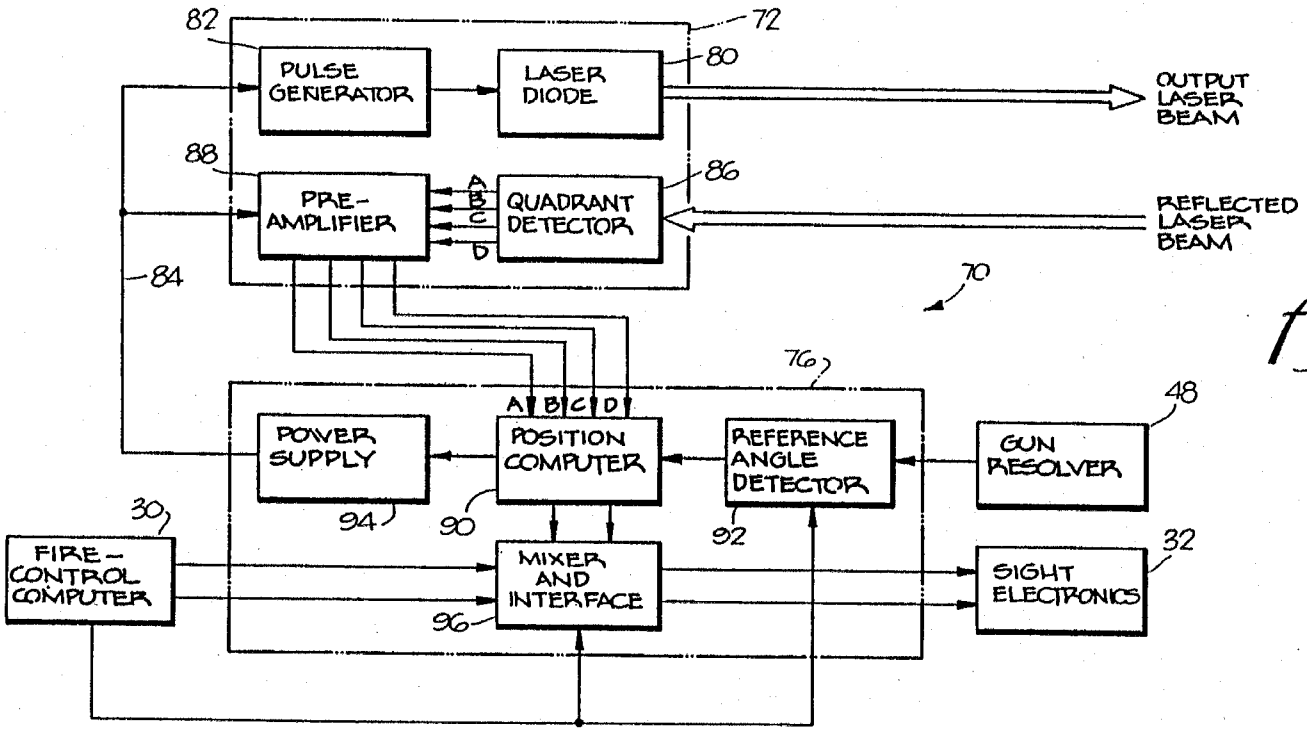
FIG. 3 is a block diagram illustrating major components of the present invention and their relationship to the fire-control and sighting systems illustrated in FIG. 2.

With reference to FIGS. 1 and 3, the muzzle reference system 70 of the present invention is comprised of three major components, namely, an infrared (IR) laser transceiver 72, a muzzle mirror 74 mounted at the muzzle end of barrel 24 and electronic processing circuitry 76. The transceiver is comprised of an integral transmitter and receiver having common optics.

In general the transmitter is arranged to produce a laser beam along an optical axis 78 toward mirror 74 at a predetermined angular vertical reference position of the gun barrel. At that position, the mirror reflects the beam along or substantially along (depending on the degree of error) optical axis 78 into the tranceiver. The receiver is responsive to the reflected beam by producing electrical signals representative of the angular deviation of the gun barrel from the reference position and feeds them to circuitry 76.

Circuitry 76 continuously monitors the position of the gun barrel and activates the transmitter whenever the gun barrel is positioned at or passes through the predetermined vertical angular reference position. Circuitry 76 also derives superelevation and lead angle correction signals on the basis of the output of the receiver and adds them to the output of computer 30 as explained in more detail later.

It is important to note at the outset that the system is fully automatic and produces correction signals virtually instantaneously upon activation of the tranceiver. The gun barrel reference angle is preferrably one which is likely to be traversed often during the normal course of operation of the tank so that the correction signals are maintained as current as possible. However, the reference angle may be any desired value.

The electronic portion of the transmitter includes a laser diode 80 driven by a pulse generator 82 which receives an enable signal from circuitry 76 along line 84. The electronic portion of the receiver is comprised of a quadrant detector 86 having four electrical output channels A, B, C and D each of which is connected to an associated preamplifier in a preamplifier circuit 88 which buffers the signals before transmission to the electronic processing circuitry 76.

As described in greater detail later, position computer 90 in electronic circuitry 76 receives and processes the four signals output from detector 86, derives elevational and azimuthal correction signals and stores them in a memory. A reference angle detector circuit 92 is connected to the output of gun resolver 48 and signals computer 90 which in turn activates pulse generator 82 via power supply 94 when the gun barrel crosses the reference angle. A correction signal mixer and interface circuit 96 adds the correction signals generated by the position computer 90 to the superelevation and lead angle signals generated by the fire-control computer 30 and feeds the sum to sight electronic circuitry 32.

Figure 5:
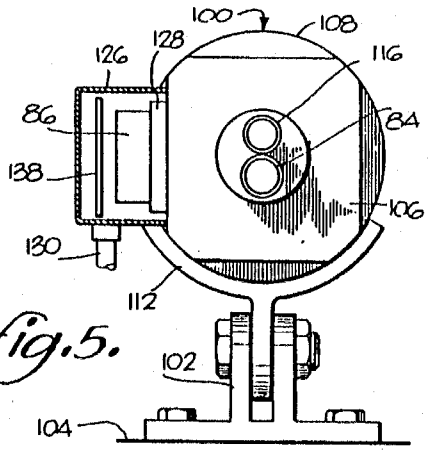
FIG. 5 is an end view of the transceiver illustrated in FIG. 4.
Figure 4:
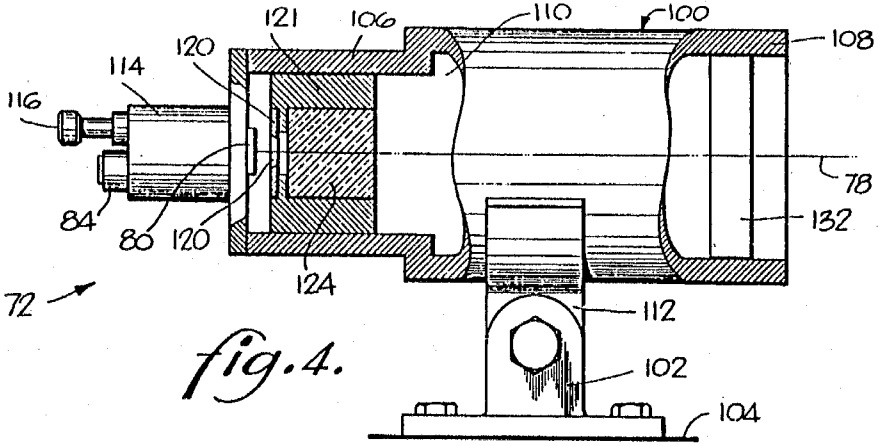
FIG. 4 is a longitudinal partial cross-sectional view of a transceiver which houses a number of the optical and electrical components of the present invention.

FIGS. 4 and 5 illustrate a preferred form of the mechanical and optical features of the transceiver. The transceiver is comprised of a tubular housing 100 which is pivotally mounted on a bifurcated support 102 bolted or otherwise secured to the turret roof 104. The housing is formed with a square parallelepiped portion 106 at one end remote from the gun barrel and a cylindrical portion 108 proximal to the gun barrel and defines an optical chamber 110 which in turn defines optical axis 78. Axis 78 is preferably disposed in a vertical plane containing the axis of the gun barrel. A Y-shaped bracket 112 depends from portion 108 for pivotal connection to support 102 so as to permit adjustment of the reference position of the gun barrel in a manner described later.

Laser diode 80 is mounted at the end of a cylindrical heat sink 114 at the remote end of square portion 106 of the housing along the optical axis 78. A micrometer device 116 provides incremental axial adjustment of the laser diode so as to provide a means of focussing the laser beam on the muzzle mirror. The laser diode electronics are connected to the muzzle reference system electronics by means of cable or line 84. Mounted within the square portion of the housing is a support 121 for a disc shaped diaphragm 120, having a square aperture 122, and a beam splitter 124, both of which are coaxial with the optical axis. A detector housing 126 is mounted on an exterior side of portion 106 of the housing and contains an infrared (IR) filter 128 and detector 86. The detector electronics are connected to the muzzle reference system electronics 76 by means of a cable 130. A lens 132 is coaxially mounted in the proximal end of housing 100 and serves to focus the square shaped beam which issues from the square aperture of the diaphragm onto the muzzle mirror.

Figure 6:
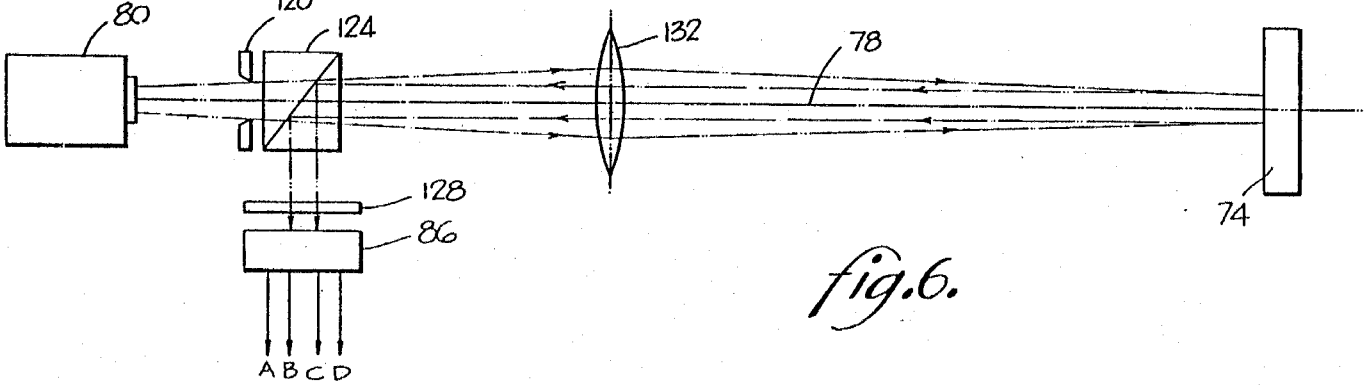
FIG. 6 is a diagrammatic view of the optical system of the present invention.

FIG. 6 diagrammatically illustrates the optical features of the transceiver. When enabled, the laser diode emits a laser beam along optical axis 78. The beam is geometrically confined by the square aperture 122 of diaphragm 120, passes through beam splitter 124 and is focalized by the lens 132 onto the muzzle mirror 74. The mirror reflects the beam back substantially along the optical axis, through the lens to the beam splitter which in turn reflects the beam through the IR filter onto the quadrant detector. In the absence of error in the system, the square-shaped beam reflected by the muzzle mirror will be axially disposed along optical axis 78. On the other hand, error is represented by deviation of the reflected beam from axis 78. It is the function of the muzzle reference system to compensate for these errors.

Any suitable laser diode may be used such as type RCA 30130 which has been found to be adequate for the purposes of the present invention. This component is a passivated double-hetero junction AlGaAs injection laser capable of continuous or high duty-cycle pulse operation at case temperatures of up to 50° C. The diode is arranged to be modulated at a frequency of 5 kHz with a duty cycle of 50%. Any appropriate laser drive circuitry may be provided. For example, the circuitry could include two timers, a first to generate a pulse train at a frequency of approximately 5 kHz and a second to adjust the duty cycle at 50%. The pulse train could drive a transistor which could switch the laser diode ON and OFF at an appropriate current. The timers would be activated by an enable signal issued by the muzzle reference system electronics.

Figure 8:
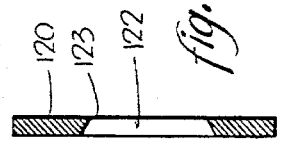
FIGS. 7 and 8 are front and cross-sectional views respectively of a laser beam shaping diaphragm.
Figure 7:
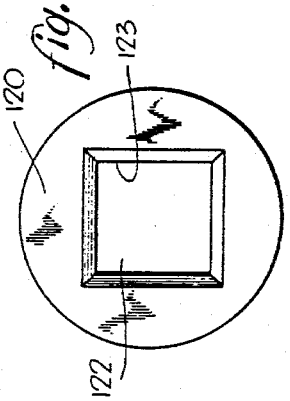
Figure 9:
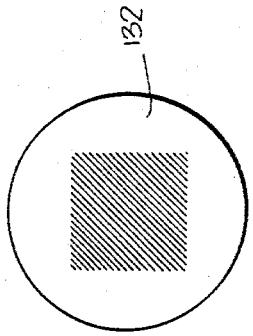
FIG. 9 is a view illstrating a square-shaped laser beam in the plane of a beam focussing lens.

As best illustrated in FIGS. 7 and 8, diaphragm 120 is planar and disc shaped with square aperture 122 being centered in the disc. The aperture is formed with knife edges 123 to enhance resolution. The diaphragm is positioned along the optical axis with respect to both the laser diode and the lens such that the length of the sides of that portion of the square beam in the plane of the lens is about one-half of the lens diameter as shown in FIG. 9. This geometry determines the range of measurable angular displacements of the gun barrel from its reference position because the reflected beam can be received by the lens even if deviated by one-half of the lens diameter.

A square shaped diaphragm aperture is preferred because it provides, within limits, a linear relationship between deviation of the beam and the output of the quadrant detector. This property considerably facilitates the derivation of the correction signals. For displacements within a particular limit from the optical axis, the electrical output of the detector as a function of the displacement tends to be much more linear than that of a circular aperture. It is to be noted, however, that the range of displacements before the square spot on the detector begins to leave the area of the detector is somewhat smaller for a square aperture than that of a corresponding circular aperture. In addition, if instead of being centered on the detector, the spot was located off axis in azimuth and with the same displacement in elevation, the range of displacement would be smaller. However, the displacements in elevation are expected to have a greater amplitude than those in azimuth and, thus, the square aperture is preferred in view of the benefits discussed above.

The requirement that the length of the sides of the square beam in the plane of the lens be one-half the diameter of the lens is a compromise between the low linearity and wide linear range possible with a larger side length and the high linearity and narrow linear range provided by a smaller side length. Notwithstanding the foregoing, it will be understood that the invention can be successfully reduced to practice with a different aperture length size and a circular aperture.

The beam splitter is in the form of a cubic glass member installed on the support between the diaphgram and the lens. A beam splitter manufactured by Melles Griot under part number 03BSC001 has been found to be adequate for the purposes of the present invention. Any suitable lens may be provided. An Aero Aktar lens manufactured by Kodak has a focal length of 305 mm and f/2.5 has been found to be adequate.

The detector is a planar diffused silicon quadrant photodiode YAG 444-4 made by EG&G. This device is specifically designed for use as a sensor in guidance, tracking and alignment applications. The detector has an electrical output terminal associated with each quadrant and the magnitude of the electrical signal at each quadrant terminal is proportional to the energy incident upon its associated quadrant.

An optical filter is located between the beam splitter and detector to reduce the ambient solar background power incident on the detector. That which is contemplated has a transmission of 0.69 at the wavelength (820 nm) of the laser diode. The blocking range of the filter (transmission $10^{-3}$ or less) extends from 700 nm to a wavelength below 400 nm. On the long wavelength side (greater than 1000 nm) the detector itself also serves as a filter.

Before being directed to the muzzle reference system electronics 76 via the cable 130, the four outputs of the detector are preamplified by means of four transimpedance amplifiers having a gain of 68 k. The amplifiers and associated electrical components are mounted on a circuit board 138 in housing 126 attached to square portion 106 of the transceiver.

Figure 10:
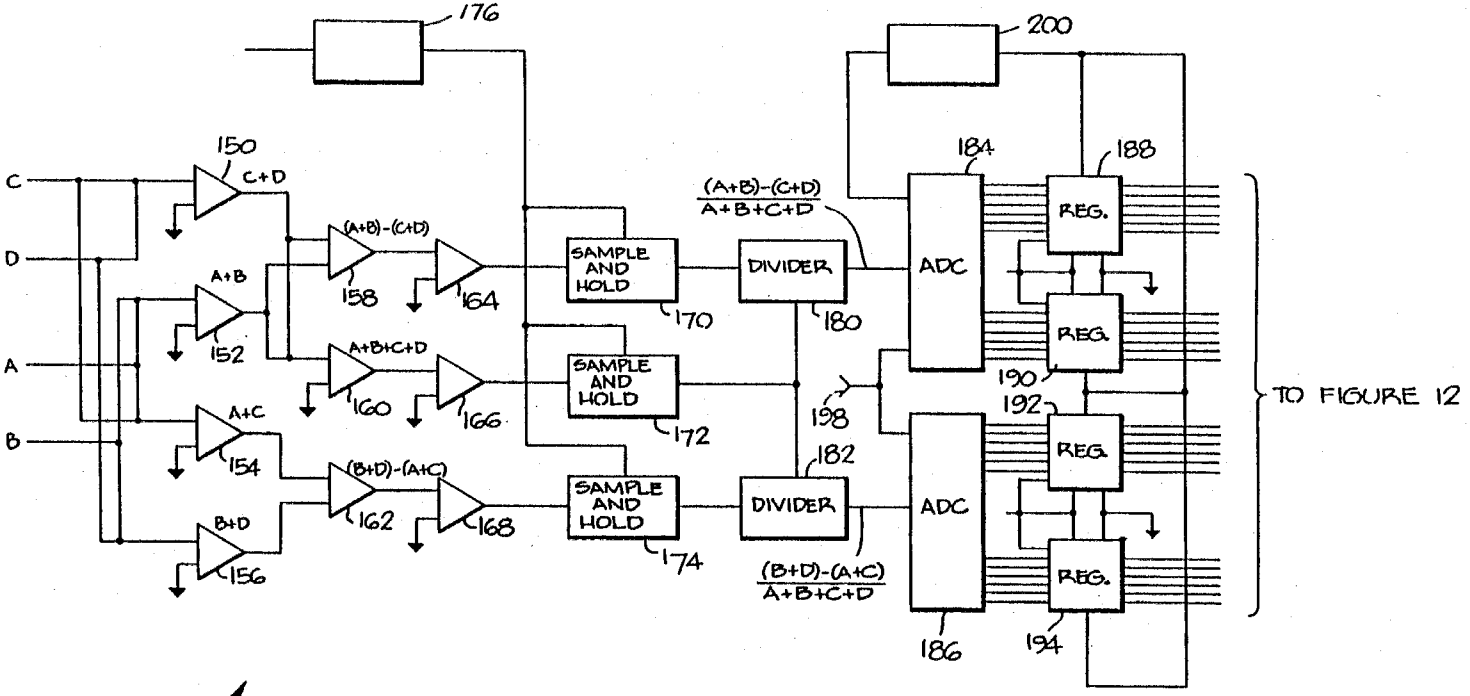
FIG. 10 is a block diagram of a position computer.
Figure 11:
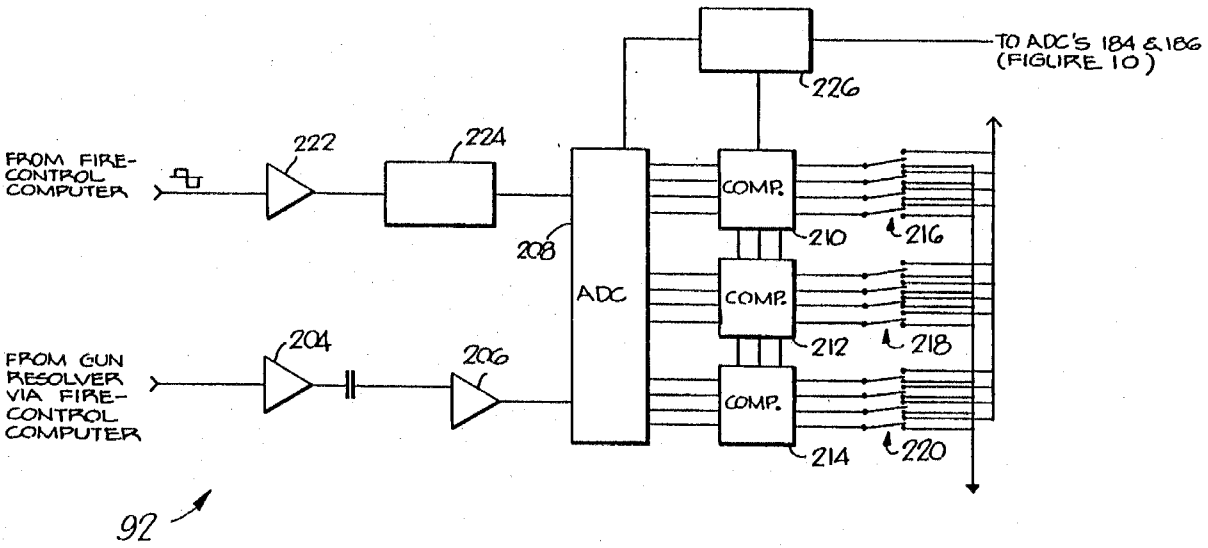
FIG. 11 is a block diagram of a muzzle angle detector circuit.
Figure 12:
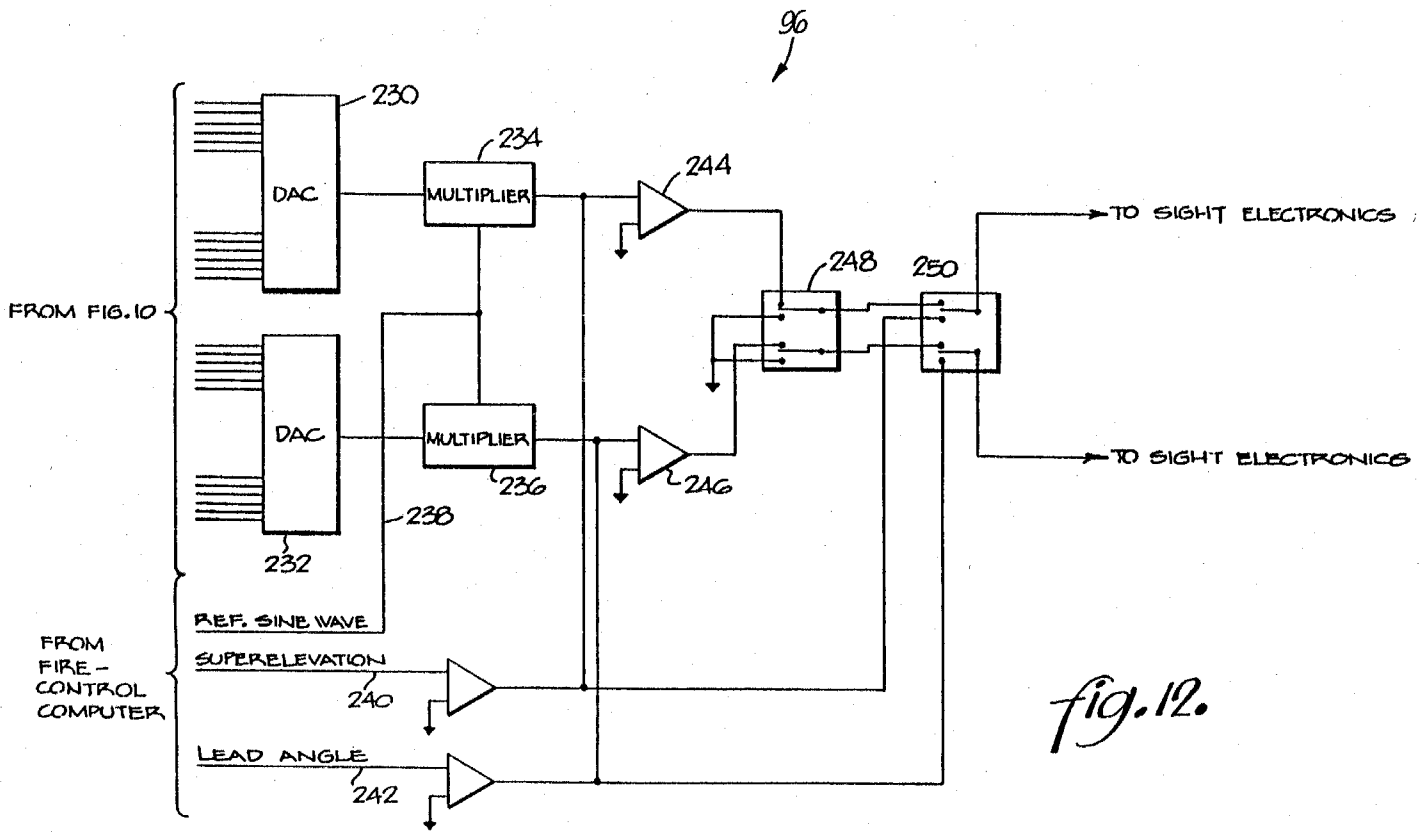
FIG. 12 is a block diagram of correction signal mixer and interface circuit.

As mentioned above, electronic circuitry 76 is comprised of three major circuits, namely, a position computer 90, a gun muzzle reference angle detector circuit 92 and a correction signal mixer and interface circuit 96 as shown in FIGS. 10–12.

The position computer serves to amplify the four signals issued by the preamplification stage of the detector, derive the azimuth and elevation signals, sum the output of the four channels of the preamplifiers, normalize the azimuth and elevation correction signals by dividing them by the sum signal in order to eliminate the effect of intensity variations of the beam reaching the detector and convert the azimuthal and elevational correction signals into digital form for storage in memory until required.

FIG. 10 is a block diagram representation of the position computer circuit 90. The four signals A, B, C and D corresponding to the four detector channels are AC coupled to four amplifiers 150, 152, 154, and 156, each having a gain of 150, to produce the sums A+B, A+C, C+D and B+D. The output of each of the four amplifiers are fed to three adders 158, 160 and 162 so as to generate an elevation signal which is the difference between the sum of channels A and B and the sum of channels C and D, an azimuth signal which is the difference between the sum of channels B and D and the sum of channels A and C and a sum signal which is the sum of the four channels. The output of the adders are fed to three amplifiers 164, 166, and 168 which are tuned at the frequency of repetition of the laser (5 kHz) in order to permit synchronous detection and reject any stray light interference. The resultant 5 kHz sine waves from amplifiers 164, 166, and 168 are fed into sample and hold amplifiers 170, 172 and 174, respectively, which sample the sine waves at their peaks. The synchronization for the sample is provided by an integrated circuit 176 which in turn receives a synchronization signal from the laser diode pulses.

The outputs of sample and hold amplifiers 170 and 174 representing the elevation and azimuth correction signals respectively are normalized by division by the output of amplifier 172 in two analog dividers 180 and 182, respectively. The normalized elevation and azimuth correction signals are then fed to analog-to-digital converters 184 and 186 respectively whose digital outputs are stored in two pairs of registers 188, 190 and 192, 194. The analog-to-digital conversion takes place only after the reception of a synchronization signal at input 198 from the reference angle detecting circuit 92 which provides the signal only when the gun barrel passes through the aforementioned gun muzzle reference angle. Integrated circuit 200 delays the end-of-conversion signals until the the ADC outputs have stabilized. The output of the registers are fed to the correction signal mixing and interface circuit illustrated in FIG. 12.

The function of the gun muzzle reference angle detecting circuit 92 is to monitor the output of the gun resolver in order to detect precisely when the gun barrel traverses a predetermined and preselectable reference angle. FIG. 11 illustrates reference angle circuit 92. An amplifier 204 buffers the 500 Hz sine wave signal issued by the tank fire-control computer and derived from the gun resolver 48. The output of the buffer is AC coupled to an amplifier 206 where it is amplified and filtered to remove the DC level and noise present in the signal. The output of amplifier 206 is fed to a 12-bit analog-to-digital converter 208, the outputs of which are compared in three digital comparators 210, 212 and 214 to the state of the switches of three switch banks 216, 218, and 220, respectively. The switch banks are the means by which the muzzle reference angle is prescribed. It will be understood that the transceiver and muzzle mirror must be aligned for the reference position selected. The analog-to-digital conversion takes place on the peak of the input sine wave, with the necessary synchronization being derived from a reference square wave in phase with the gun resolver signal obtained from the tank fire-control computer via amplifier 222 and IC 224. An end-of-conversion synchronization signal is generated by an integrated circuit 226 to validate the output of the digital comparator. Finally, integrated circuit 226 feeds a synchronization signal to ADCs 184 and 186 of position computer 90 via line 198 to initiate a conversion there when equality between the switch banks and the analog-to-digital converter 208 output is detected.

FIG. 12 illustrates the correction signal mixer and interface circuit 96. The correction signal mixer and interface circuit converts into analog DC voltages the elevation and azimuth correction signals stored in the position computer registers 188, 190, 192 and 194. The DC voltages are then converted into 500 Hz sine waves compatible with the two ballistic correction signals produced by the tank fire-control computer.

Two 12-bit digital-to-analog converters 230 and 232 convert the digital elevation and azimuth correction signals into analog signals. The resulting DC level outputs of DACs 230 and 232 are multiplied in multipliers 234 and 236 by a 500 Hz reference sine wave received from the fire-control computer along line 238 so as to be compatible with the fire-control computer superelevation and lead angle signals generated by the fire-control computer and received by interface circuit 96 along lines 240 and 242. The resulting elevational and azimuthal correction signals output by multipliers 234 and 236 respectively are added in adders 244 and 246 to the superelevation and lead angle signals respectively from lines 240 and 242. The resulting outputs are then fed into two consecutive switches 248 and 250 which permit bypassing of the muzzle reference system electronics, clamping to zero the superelevation and lead angle signals directed to the side electronic box when an MRS reference is being effected, or, of course, connecting the muzzle reference system output signals to the sight electronics. The purpose of clamping the signals to zero is to permit a correction independently of bore sight adjustments or ammunition types currently valid at the moment the reference takes place.

Before the muzzle reference system can be used, it is necessary to establish the reference position of the muzzle. This is accomplished when the transceiver and mirror are initially mounted onto the artillery gun but can be effected at any time. After the transceiver and mirror have been loosely mounted into their respective positions, the barrel is angularly elevated to the desired reference position. With the barrel stationary and the diode enabled, the transceiver and mirror are adjusted such that the quadrant detector registers zero deviation, at which time the transceiver and mirror are secured in position. In addition, switch banks 216, 218 and 220 are set to the corresponding positions. In these positions of the transceiver, mirror and muzzle, the reflected laser beam is concentric with optical axis 78.

When the gunner wishes to compensate for error which may have accummulated in the fire-control system, he simply slews the gun in elevation through the selected angle. When the gun angle transducer output equals this predetermined angle, circuit 76 enables diode 80 and a beam is generated along optical axis 78 as previously explained.

It will be seen from the foregoing that the muzzle reference system of the present invention is fully automatic and extremely fast. The use of a square diaphragm in conjunction with a quadrant detector results in excellent linearity in signal transfer between quadrant pairs when the gun barrel is displaced angularly. It will be seen further that the introduction of correction signals to the conventional fire-control system by intercepting the fire-control signals in an adapter cable permits retrofit of existing fire-control systems without any modification to the computer, the gunner's sight or the wiring harness. Further, it will be seen that the correction provided covers the full spectrum of errors which arise between the gun muzzle and the gunner's sight. Finally, the present system is applicable even in those cases where there is no line of sight between the gun muzzle and the gunner's sight. Thus, the system is not dependent upon the availability of an appropriate target.

It will be understood that various modifications and alterations may be made to the description without departing from the spirit of the invention as defined by the appended claims.

The embodiments of the invention in which an exclusive property or privilege is claimed are defined as follows:

1. A muzzle reference system for correcting errors in aiming signals produced by a fire-control system of an artillery gun having a gun barrel pivotable about a first axis and movable about a second axis extending perpendicularly of said first axis, said muzzle reference system comprising:

laser beam transmitting means adapted to be mounted on a turret of said gun for movement with said barrel about said second axis and directing a focalized laser beam along a predetermined optical axis in response to an activating signal;

mirror means adapted to be mounted at the muzzle end of said barrel for reflecting said laser beam received from said transmitting means along said predetermined optical axis substantially along a reference optical axis at a predetermined angular position of said barrel about said first axis;

laser beam receiving means adapted to be mounted on said turret of said gun for receiving a laser beam reflected substantially along said reference optical axis and producing deviation representantive signals representative of the deviation of said reflected beam from said reference optical axis;

means connected to said receiving means and adapted to be connected to said fire-control system for converting said deviation representative signals to aiming correction signals and for adding the latter to said aiming signals; and means for monitoring the position of said barrel about said first axis and applying said activating signal to said transmitting means when said barrel is at said predetermined angular position.

2. A muzzle reference system as defined in claim 1, said transmitting means including means for focussing said laser beam on said reflecting means at said predetermined angular position of said barrel.

3. A muzzle reference system as defined in claim 2, said focussing means being a lens axially disposed along said optical axis.

4. A muzzle reference system as defined in claim 2, said transmitting means including means for producing said laser beam, said producing means being adjustably movable along said optical axis for focussing of said beam on said reflecting means.

5. A muzzle reference system as defined in claim 1, said transmitting means including means for forming said beam into a beam having a square cross-sectional shape.

6. A muzzle reference system as defined in claim 5, said transmitting means further including lens means axially disposed between said forming means and said reflecting means for focussing said square-shaped beam onto said reflecting means.

7. A muzzle reference system as defined in claim 6, said lens means being axially spaced from said forming means whereby the length of a side of said square-shaped beam in the plane of said lens means is about one-half of the diameter of said lens.

8. A muzzle reference system as defined in claim 7, said optical axis and said reference optical axis being coaxial.

9. A muzzle reference system as defined in claim 1, said receiving means including optical-to-electrical transducer means, having a plurality of detecting surfaces, each said surface having an electrical output representative of the magnitude of light energy incident on said surface.

10. A muzzle reference system as defined in claim 9, further including a filter means for filtering ambient light from the light incident upon said transducer means surfaces.

11. A muzzle reference system as defined in claim 10, said receiver means further including amplifier means associated with each said electrical output for providing a plurality of amplified electrical outputs.

12. A muzzle reference system as defined in claim 1, said receiver means including a quadrant photodetector having an output terminal associated with each quadrant of said detector and providing an electrical signal at each said terminal representative of the magnitude of the portion of said reflected laser beam incident upon the quadrant associated with each said terminal.

13. A muzzle reference system as defined in claim 12, said converting means including first electrical circuit means for converting said photodetector electrical output signals into said aiming correction signals.

14. A muzzle reference system as defined in claim 13, further including second electrical circuit means for adding said correction signals and said aiming signals and applying the sum of said signals to a sight electronics circuit of said gun.

15. A muzzle reference system for producng superelevation and lead angle correction signals for addition to superelevation and lead angle signals, respectively, produced by a fire-control computer of an artillery gun, said gun having a support structure, a turret mounted on said support structure for movement about a vertical axis, a gun barrel mounted on said turret for movement in a vertical plane about a horizontal axis, a sighting system connected to said fire-control computer and being responsive to said superelevation and lead angle signals by positioning a sighting telescope in accordance with signals, and means for producing continuous signals representative of the angular position of said barrel in said plane; said muzzle reference system comprising:

a transceiver adapted to be mounted on said turret, said transceiver having laser beam transmitter means for producing a focalized laser beam along an optical axis in said plane and within the range of movement of said barrel in said plane in response to an enable signal, and a receiver responsive to a laser beam reflected substantially along said axis for producing electrical error signals representative of the elevational and azimuthal deviation of said reflected beam from said optical axis;

mirror reflector means adapted to be mounted at the muzzle end of said barrel for reflecting a laser beam produced by said transmitter means substantially along said optical axis at a predetermined angular position of said barrel;

means for converting said elevational and azimuthal error signals to superelevation and lead angle correction signals and adding said signals to said superleevation and lead angle signals respectively produced by said fire-control computer; and means for monitoring the output of said continuous signal producing means and producing said enable signal when said barrel is disposed at said predetermined angular position.

16. A muzzle reference system as defined in claim 15, said transceiver including transmitter means for forming a laser beam having a square cross-sectional shape.

17. A muzzle reference system as defined in claim 16, said transceiver means including a lens for focussing said square-shaped laser beam on said reflector means.

18. A muzzle reference system as defined in claim 17, said transceiver being arranged such that the length of a side of said beam in the plane of said lens is about one-half the diameter of said lens.

19. A muzzle reference system as defined in claim 17, said receiver including a disc-shaped quadrant detector having four quadrants, each said quadrant having an electrical output terminal for producing thereat an electrical signal proportional to the magnitude of the optical energy incident upon it.

20. A muzzle reference system as defined in claim 17, said forming means being a diaphragm having a square aperture centred on said optical axis.

21. A muzzle reference system as defined in claim 20. said receiver including a detector, and said transceiver including a beam splitter disposed between said lens and said diaphragm along said optical axis said reflecting said reflected laser beam unto said detector.

22. A muzzle reference system as defined in claim 21, said receiver including an IR filter interposed between said detector and said beam splitter for removing ambient light from said reflected beam.

23. A muzzle reference system as defined in claim 22, said transceiver including a housing for said transmitter means and said receiver, said housing being adapted to be mounted on said turret and angularly adjustable about an axis parallelling said horizontal axis.

24. A muzzle reference system as defined in claim 15, said transceiver comprising:

a tubular housing having an optical chamber defining said optical axis;

laser beam producing means axially adjustably mounted at one end of said chamber remote from said barrel;

a lens mounted at another end of said chamber for focussing said beam on said reflector means;

laser beam shaping means axially disposed in said chamber between said producing means and said lens for forming a laser output beam having a square cross-sectional shape, said shaping means being spaced from said lens whereby the length of a side of said output beam in the plane of said lens is about one-half of the lens diameter;

a quadrant photodetector secured to said housing, each quadrant having a detecting surface for receiving at least a portion of said reflected laser beam and an output terminal for providing an electrical signal representative of the magnitude of photo-energy incident upon its associated surface; and a beam splitter axially interposed between said lens and said shaping means for reflecting said reflected beam reflected substantially along said optical axis onto said detector surfaces.

* * * * *